US005668440A

United States Patent [19]

Inukai et al.

[11] Patent Number: 5,668,440

[45] Date of Patent: Sep. 16, 1997

[54] NITRIDE LAYER FOR DISCHARGE LAMPS

[75] Inventors: Shinji Inukai, Yokohama; Kazuo Takita; Makoto Nishizawa, both of Yokosuka; Akira Itoh, Yokohama; Kazuyoshi Okamura, Yokosuka; Kazuiki Uchida, Fujisawa; Takayuki Aoki, Yokosuka; Kazuhiko Yoshikawa, Yokohama; Akihiro Yonezawa, Yokosuka; Hiroki Sasaki, Yokohama, all of Japan

[73] Assignee: Toshiba Lighting & Technology Corporation, Tokyo, Japan

[21] Appl. No.: 443,157

[22] Filed: May 17, 1995

[30] Foreign Application Priority Data

May 17, 1994 [JP] Japan ..... 6-102580

[51] Int. Cl.[6] ..... H01J 61/35

[52] U.S. Cl. ..... 313/635; 313/489

[58] Field of Search ..... 313/635, 489, 313/641, 640, 113, 638, 623, 33

[56] References Cited

U.S. PATENT DOCUMENTS

| | | | |
|---|---|---|---|
| 3,558,963 | 1/1971 | Hanneman | 313/641 |
| 3,569,766 | 3/1971 | Larson | 313/641 |
| 3,988,628 | 10/1976 | Clausen . | |
| 4,769,748 | 9/1988 | Levin et al. | 362/214 |
| 5,402,038 | 3/1995 | Parham et al. | 313/623 |
| 5,500,571 | 3/1996 | Okada et al. | 313/365 |

FOREIGN PATENT DOCUMENTS 2 191 888 12/1987 United Kingdom .

OTHER PUBLICATIONS

Patent Abstracts of Japan, vol. 16, No. 191 (M–1245), May 8, 1992, JP 04 026002, Jan. 29, 1992, and GB 2 244 123, Nov. 20, 1991.

Patent Abstracts of Japan, vol. 12, No. 146 (E–605), May 6, 1988, JP 62 262358, Nov. 14, 1987.

Patent Abstracts of Japan, vol. 17, No. 249 (E–1366), May 18, 1993, JP 04 370644, Dec. 24, 1992.

Patent Abstracts of Japan, vol. 5, No. 74 (E–57) (746), May 16, 1981, JP 56 022041, Mar. 2, 1981.

Patent Abstracts of Japan, vol. 1, No. 5 (M–004), Mar. 11, 1977, JP 51 120075, Oct. 21, 1976.

Patent Abstracts of Japan, vol. 1, No. 5 (M–004), Mar. 11, 1977, JP 51 120076, Oct. 21, 1976, and Derwent Publications, AN 76–91479X [49], JP 51 120076, Oct. 21, 1976.

*Primary Examiner*—Michael Horabik
*Assistant Examiner*—Michael Day
*Attorney, Agent, or Firm*—Oblon, Spivak, McClelland, Maier & Neustadt, P.C.

[57] ABSTRACT

In a discharge lamp having a discharge medium sealed in a discharge tube assembly including electrodes for producing a discharge, a nitride layer is formed on a surface of an envelope tube of the discharge tube assembly. The nitride layer is formed by substituting an oxygen component of an oxide constituting the tube wall of the envelope tube with nitrogen, and exhibits a continuous and smooth reduction in nitride content in the direction of depth. This chemically stable nitride layer prevents a reaction between the discharge medium and the tube wall material, and removal or injection of the discharge medium. In addition, since the nitride layer also exhibits a continuous change in thermal expansion coefficient in the direction of depth, the thermal stress is reduced, and cracking, peeling, removal, and the like do not occur.

11 Claims, 6 Drawing Sheets

NITRIDE LAYER FOR DISCHARGE LAMPS

BACKGROUND OF THE INVENTION

1. Field of the Invention

The present invention relates to a discharge lamp such as a mercury lamp, a metal halide lamp, or a high pressure sodium lamp, a discharge lamp lighting apparatus, and an illumination apparatus using the same.

More particularly, the present invention relates to a discharge lamp in which a nitride layer is formed on the surface of the tube wall of the envelope tube of a discharge tube assembly to prevent a reaction between a discharge medium sealed in the envelope tube and a tube wall material, thereby improving the performance.

2. Description of the Prior Art

In general, a material for the discharge tube assembly of a high pressure metal vapor discharge lamp is selected in consideration of transparency, heat resistance, chemical resistance, workability, and the like. A discharge tube assembly consisting of quartz is used for a high pressure mercury lamp or a metal halide lamp, whereas a discharge tube assembly consisting of a transparent ceramic material, e.g., an alumina ($Al_2O_3$) ceramic material is used for a high pressure sodium lamp.

Even if the above discharge tube assembly materials are used for such discharge lamps, the problem of a decrease in luminous flux after a long-term use still remains unsolved.

There are various causes of a decrease in luminous flux. One of the causes is a reaction between a discharge medium sealed in a discharge tube assembly and a discharge tube assembly material.

For example, in a metal halide lamp, when a metal halide or a discharge metal dissociated therefrom, which is sealed in a discharge tube assembly consisting of quartz, reacts with the quartz, discoloration of the quartz occurs. For this reason, the light transmission characteristics deteriorate. A decrease in luminous flux is also caused by a reduction in the amount of discharge metal. As a result, the luminous flux maintaining rate decreases.

In a high pressure sodium lamp, a reaction product is produced by a reaction between sodium or sodium ions sealed in a discharge tube assembly consisting of an alumina ceramic material and the discharge tube assembly. As a result, so-called sodium loss occurs, and an increase in discharge voltage or a decrease in luminous flux occurs.

In a medium pressure mercury lamp, mercury sealed in a discharge tube assembly consisting of quartz is injected into the quartz. As a result, the discharge tube assembly is blackened.

In order to eliminate such drawbacks, Jpn. Pat. Appln. KOKOKU Publication No. 57-44208 discloses a technique of coating a silicon nitride ($Si_3N_4$) film on the inner surface of a discharge tube assembly. According to this technique, when the silicon nitride film described in the above official gazette is formed on the inner surface of the discharge tube assembly, the film moderate a reaction between the discharge metal and the discharge tube assembly, and prevents removal of the discharge medium, thereby preventing a decrease in luminous flux and maintaining a high luminous flux.

In addition, in the technique disclosed in Jpn. Pat. Appln. KOKAI Publication No. 62-262358, an aluminum nitride coating is formed on the inner surface of an alumina discharge tube assembly to decrease the temperature of a central portion of the discharge tube assembly, thereby reducing sodium loss.

In either of the above conventional techniques, however, since the silicon nitride or aluminum nitride film, which is different from the material of the tube wall of the envelope tube of the discharge tube assembly, is formed on the inner surface of the envelope tube, the discharge tube assembly material is different from the film material in thermal expansion coefficient. For this reason, the silicon nitride or aluminum nitride film may undergo cracking, peeling, removal, or the like.

In the latter official gazette, in order to solve this problem, the thickness of the aluminum nitride film is set to be 5 μm or less. Even if, however, the film thickness is set to be 5 μm or less, cracking or the like may take place. That is, it is difficult to form a sufficiently effective film. No such a film has been put into practice.

It is an object of the present invention to provide a discharge lamp in which a chemically and physically stable nitride layer is formed on the surface of the envelope tube of a discharge tube assembly to prevent a reaction between a discharge medium and the material of the envelope tube of the discharge tube assembly and removal of the discharge medium, thereby maintaining a high luminous flux maintaining rate and preventing cracking, peeling, removal, and the like, and an illumination apparatus using this discharge lamp.

SUMMARY OF THE INVENTION

In order to achieve the above object, according to the present invention, there is provided a discharge lamp comprising: a discharge tube assembly constituted by an envelope tube having a tube wall consisting of an oxide material and a nitride layer containing a nitride and formed on an inner surface of the tube wall, and a discharge medium sealed in the envelope tube; and means for producing a discharge in the discharge tube assembly. The nitride layer exhibits a continuous and smooth reduction in nitride content in the direction of depth of the tube wall.

In this case, the means for producing a discharge in the discharge tube assembly includes an electrode, an electromagnetic induction coil, and the like arranged on the outer surface of the envelope tube in addition to electrodes sealed in the envelope tube.

The expression "continuous and smooth reduction" in nitride content in the direction of depth has mathematical meanings, and "smooth" indicates that the characteristic curve representing the reduction in nitride content in the direction of depth can be continuously differentiated. This means that the characteristic curve representing the reduction in nitride content in the direction of depth is continuous and smooth, and the change ratio of the nitride content, i.e., the slope of this characteristic curve, also changes continuously.

According to such characteristics, the nitride layer containing the nitride is formed on the inner surface of the envelope tube. Therefore, this chemically stable nitride prevents a reaction between the discharge medium and the material of the tube wall of the envelope tube of the discharge tube assembly, and removal of the discharge medium or injection of an ionized discharge medium into the inner surface of the tube wall.

In this nitride layer, the characteristic curve representing the reduction in nitride content in the direction of the depth of the tube wall is continuous and smooth, and the reduction ratio, i.e., the slope of the characteristic curve, also changes continuously.

In such a nitride layer, since the composition changes continuously in the direction of depth, a change in thermal expansion coefficient in the direction of depth is also continuous. This prevents cracking or peeling of the nitride layer.

In this discharge lamp, heat generated by a discharge in the discharge tube assembly is dissipated outside through the tube wall of the envelope tube, and the heat flows at a large thermal flux in the direction of thickness of the tube wall. In such a case, when the nitride layer has a portion in which the reduction ratio of the nitride content exhibits a discontinuous change, i.e., the slope of the characteristic curve exhibits a discontinuous change, a large thermal stress is produced in this portion. In this nitride layer, however, since the reduction ratio of the nitride content, i.e., the slope of the characteristic curve, is continuous in the direction of depth, cracking or peeling of the nitride layer is not caused by such a thermal flux.

The above nitride layer is formed by substituting oxygen atoms of an oxide material constituting the tube wall of the envelope tube with nitrogen atoms. According to another means, a film containing a nitride is coated on the surface of the tube wall of the envelope tube, and nitrogen atoms in the film and oxygen atoms in the oxide material of the tube wall are diffused and substituted with each other.

In the nitride layer formed in this manner, oxygen and nitrogen atoms are substituted with each other in the material of the tube wall of the envelope tube with a behavior at the atomic level. Therefore, this substitution ratio, i.e., the nitride content, exhibits the above characteristics in the direction of depth.

According to a preferred embodiment, the nitride layer described above is formed such that the depth of a portion in which the nitride content decreases to 50% of the nitride content of the surface of the nitride layer is 10 nm or more from the surface. Such a nitride layer exhibits a small reduction ratio of the nitride content, and further reduces the thermal stress, thereby preventing cracking or peeling of the nitride layer more reliably. In general, the thermal expansion coefficient of a nitride is larger than that of an oxide in the tube wall of the envelope tube. For this reason, if the thickness of the nitride layer is set to be relatively large, the thermal conductivity in the planar direction of the tube wall of the envelope tube is increased. Therefore, the nonuniformity of heat in the planar direction, e.g., between the central portion and end portions of the envelope tube, is reduced, resulting in a reduction in thermal stress.

Some discharge lamp has a discharge tube assembly in which a through hole is formed in the envelope tube, and the conductor of the discharge means is inserted and sealed in the through hole with an inorganic adhesive, as in the case of a discharge tube assembly consisting of a transparent ceramic material. In this case, the nitride layer on at least the inner surface of the through hole is preferably formed such that the depth of a portion in which the nitride content decreases to 50% of the nitride content of a surface of the nitride layer is 100 nm or less from the surface. With this structure, the difference in thermal expansion coefficient between the inorganic adhesive and the inner surface of the through hole is reduced to allow reliable sealing.

In addition, the above nitride layer may be formed on the surface of the envelope tube after electrodes are sealed in the envelope tube of the discharge tube assembly. With this process, the hermetic state of the seal portion for each electrode can be maintained.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out in the appended claims.

BRIEF DESCRIPTION OF THE DRAWINGS

The accompanying drawings, which are incorporated in and constitute a part of the specification, illustrate presently preferred embodiments of the invention and, together with the general description given above and the detailed description of the preferred embodiments given below, serve to explain the principles of the invention.

DETAILED DESCRIPTION OF THE PREFERRED EMBODIMENTS

Figure 1A:
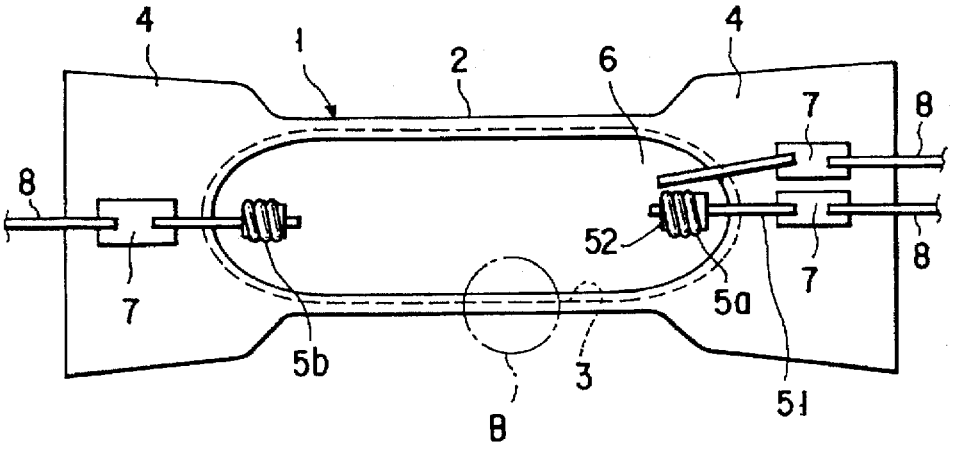
FIG. 1A is a front view showing the discharge tube assembly of a metal halide lamp according to the first embodiment of the present invention.
Figure 1B:
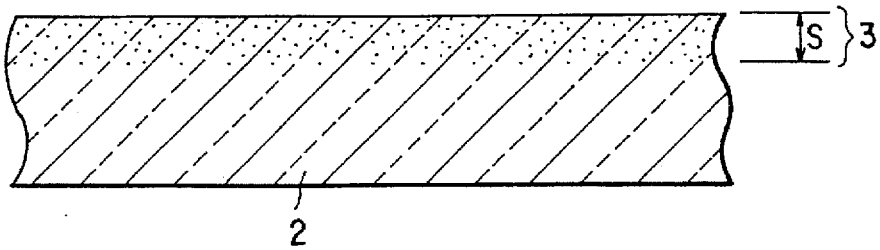
FIG. 1B is a schematic sectional view showing part of the tube wall of an envelope tube in FIG. 1A.
Figure 3:
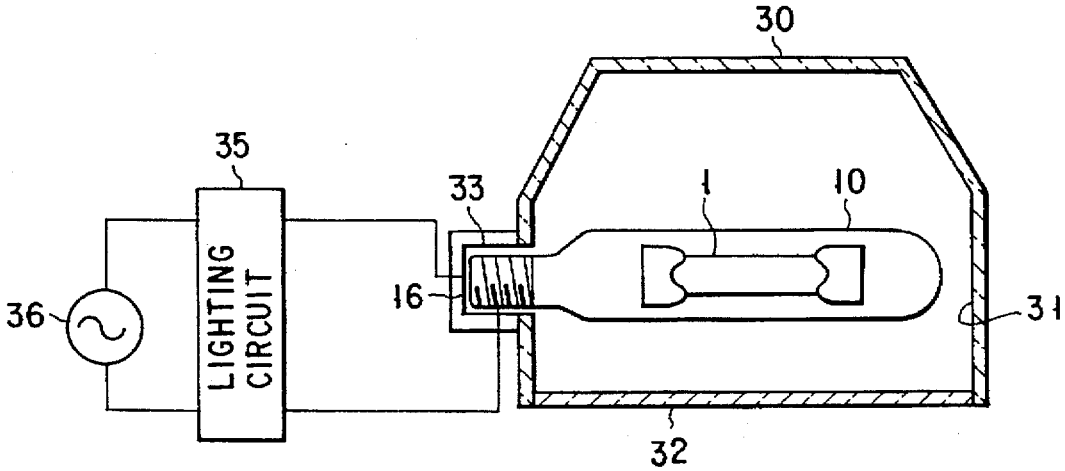
FIG. 3 is a schematic view showing an illumination apparatus using the metal halide lamp in FIG. 2, together with a lighting apparatus.
Figure 2:
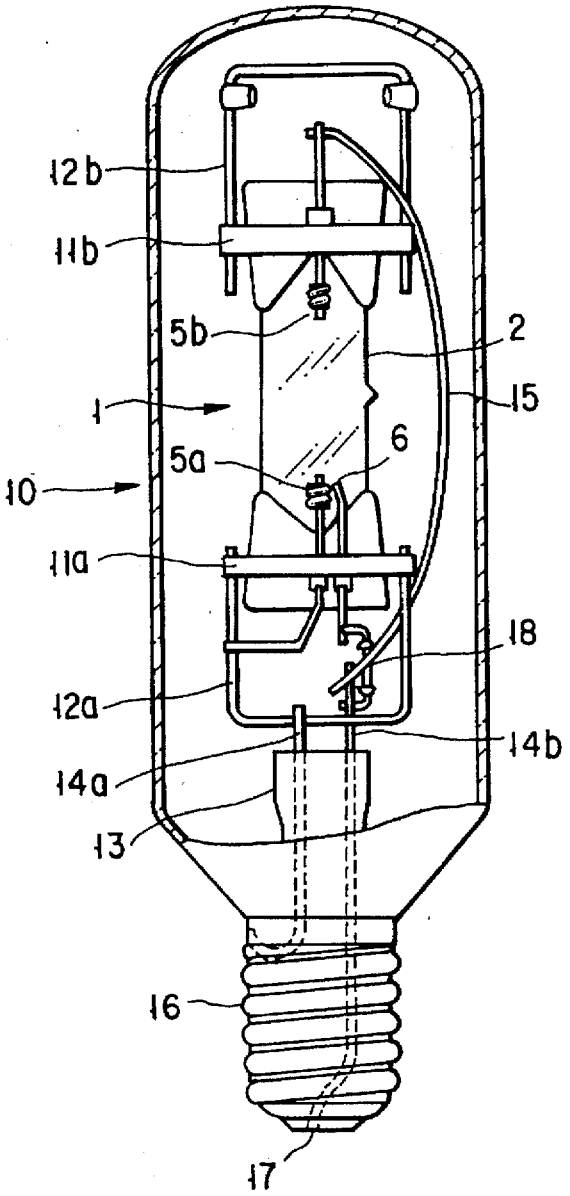
FIG. 2 is a front view showing the overall metal halide lamp according to the first embodiment.

FIGS. 1A to 3 show a metal halide lamp according to the first embodiment of the present invention. FIG. 1A shows the arrangement of the discharge tube assembly of the metal halide lamp. FIG. 2 shows the overall arrangement of the metal halide lamp. FIG. 3 is a sectional view showing an illumination apparatus using the meal halide lamp as a light source.

Referring to the overall arrangement shown in FIG. 2, reference numeral 10 denotes an outer tube consisting of hard glass, in which a nitrogen gas atmosphere is maintained. A discharge tube assembly 1 is housed in the outer tube 10.

As shown in FIG. 1A, the discharge tube assembly 1 has pinch seal portions 4 formed at the two end portions of an envelope tube 2 consisting of quartz glass. A nitride layer 3 is formed near, for example, on the entire inner surface of the envelope tube 2. The nitride layer 3 is a surface layer containing a nitride, silicon nitride in this embodiment, formed when the oxygen atoms in an oxide, e.g., quartz $SiO_2$, as a material for the tube wall of the envelope tube 2 of the discharge tube assembly 1 are substituted with nitrogen atoms.

When an ammonia ($NH_3$) atmosphere set in the envelope tube 2 is heated to a high temperature, reactions indicated by, for example, the following chemical formulae take place. With such reactions, the oxygen atoms of quartz $SiO_2$ are substituted with nitrogen atoms to form silicon nitride, thereby forming the above nitride layer 3 on the tube wall of the envelope tube 2.

Initial reaction $$\equiv Si-O-Si\equiv + NH_3 \longrightarrow \equiv Si-NH_2 + \equiv Si-OH \quad (1)$$

or $$\equiv Si-OH + NH_3 \longrightarrow Si-NH_2 + H_2O\uparrow \quad (2)$$

Secondary reaction $$\equiv Si-NH_2 + \equiv Si-OH \longrightarrow \equiv Si-\underset{\underset{H}{|}}{N}-Si\equiv + H_2O\uparrow \quad (3)$$

$$\equiv Si-\underset{\underset{H}{|}}{N}-Si\equiv + \equiv Si-OH \longrightarrow \equiv Si-\underset{\underset{Si}{|}}{\overset{\overset{|||}{}}{N}}-Si\equiv + H_2O\uparrow \quad (4)$$

or $$\equiv Si-NH_2 + \equiv Si-O-Si\equiv \longrightarrow \equiv Si-\underset{\underset{Si}{|}}{\overset{\overset{|||}{}}{N}}-Si\equiv + H_2O\uparrow \quad (5)$$

Main electrodes 5a and 5b are sealed in the pinch seal portions 4 formed at the two ends of the envelope tube 2 having the above arrangement, and a starting auxiliary electrode 6 is sealed near one main electrode 5a.

Each of the main electrodes 5a and 5b is formed by winding an electrode coil 52, consisting of tungsten, around an electrode shaft 51 consisting of tungsten W or a tungsten material containing thorium Th. An electron emissive material (emitter) (not shown) consisting of dysprosium oxide $Dy_2O_3$, scandium oxide $Sc_2O_3$, or the like is coated on the electrode coil 52. The auxiliary electrode 6 is made of a tungsten wire.

The main electrodes 5a and 5b and the auxiliary electrodes 6 are respectively connected to external lead wires 8 via metal foil conductors 7 consisting of molybdenum Mo or the like and sealed in the pinch seal portions 4.

In this envelope tube 2, predetermined amounts of mercury Hg, metal halides, e.g., scandium iodide $ScI_3$ and sodium iodide NaI, and argon Ar as a starting rare gas are sealed.

As shown in FIG. 2, the discharge tube assembly 1 having the above arrangement is housed in the outer tube 10. More specifically, the pinch seal portions 4 at the two ends of the discharge tube assembly 1 are respectively supported by supports 12a and 12b via holders 11a and 11b. One support 12a is welded to one conductive wire 14a sealed in a stem 13, whereas the other support 12b is engaged with the top portion of the outer tube 10.

One main electrode 5a of the discharge tube assembly 1 is electrically connected to one support 12a. The other main electrode 5b of the discharge tube assembly 1 is connected, via a lead wire 15, to the other conductive wire 14b sealed in the stem 13.

The auxiliary electrode 6 of the discharge tube assembly 1 is connected to the other conductive wire 14b via a starting resistor 18.

One conductive wire 14a is connected to a base 16 mounted at an end portion of the outer tube 10. The other conductive wire 14b is connected to an external terminal 17 of the base 16.

The nitride layer 3 formed on the inner surface of the tube wall of the envelope tube 2 of the discharge tube assembly 1 will be described in detail below.

Figure 10:
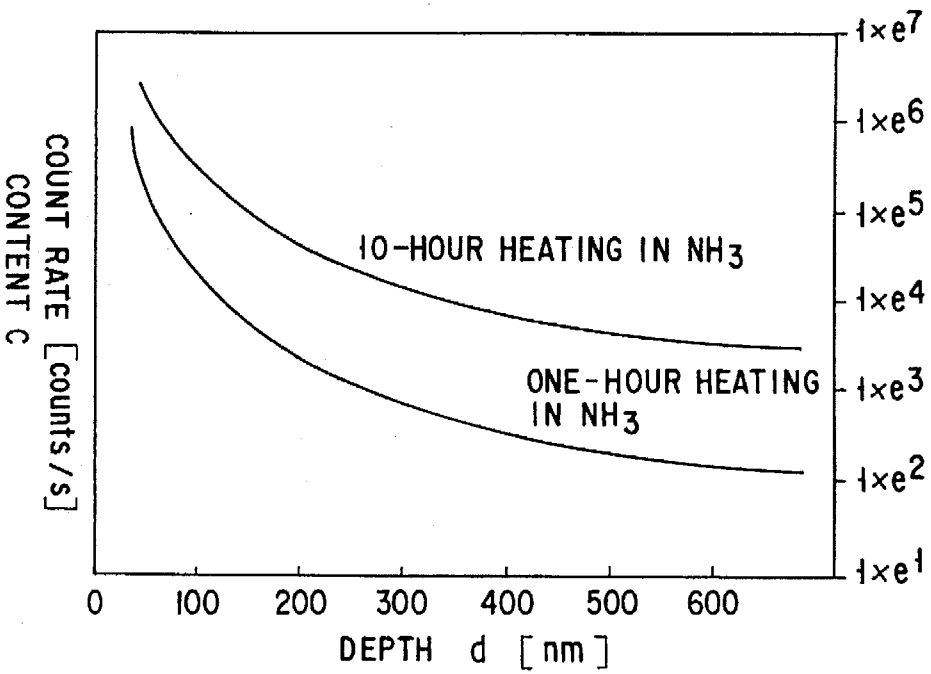
FIG. 10 is a graph showing characteristics representing a reduction in the nitride content of a nitride layer in the direction of depth.

As shown in FIG. 10, in the nitride layer 3, the nitride content, i.e., a silicon nitride content C, exhibits a continuous and smooth change, from the inner surface of the envelope tube 2, in the direction of a depth d of the tube wall of the envelope tube 2, and hence no clear boundary is formed. The content profile shown in FIG. 10 has been obtained by counting the nitrogen atoms in the nitride layer by means of SIMS (Secondary Ion Mass Spectrometry). The count rate of nitrogen atoms corresponds to the nitrogen content in the layer. The content C of silicon nitride molecules is about 60% in a portion of the nitride layer 3 at a position very near its surface. FIG. 10 roughly shows characteristics representing a reduction in nitride content, i.e., silicon nitride content C with respect to the depth d of the tube wall of the envelope tube 2.

The characteristics representing the reduction in the silicon nitride content C shown in FIG. 10 are based on the above-described atomic-level behavior that the nitrogen atoms in the ammonia gas are diffused in the quartz material of the tube wall of the envelope tube 2 and substitute the oxygen atoms in the quartz. The characteristic curve representing the reduction in nitride (silicon nitride) content exhibits a continuous and smooth reduction, as shown in FIG. 10.

Note that the expression "continuous and smooth" has mathematical meanings, and "smooth" indicates that the function of the characteristic curve shown in FIG. 10 or the function of a curve approximated thereto can be continuously differentiated.

In this nitride layer 3, a nitride, e.g., silicon nitride, is contained in a portion very near the surface, i.e., a portion in contact with a discharge medium, at a high ratio. Therefore, this chemically stable nitride serves to prevent a reaction between the discharge medium and the material of the tube wall of the envelope tube 2 of the discharge tube assembly 1 or prevent removal of a discharge medium or injection of an ionized discharge medium into the tube wall.

In addition, since the composition of the nitride layer 3 continuously changes in the direction of the depth d, a change in thermal expansion coefficient in the direction of the depth d is also continuous. This reduces the thermal stress and prevents cracking or peeling of the nitride layer 3. Furthermore, in the discharge lamp, heat generated by a discharge in the discharge tube assembly 1 is dissipated outside via the tube wall of the envelope tube 2, and heat flows in the direction of thickness of this tube wall at a large thermal flux. In such a case, if the nitride layer 3 has a portion exhibiting a discontinuous change in the reduction ratio of the nitride, i.e., the slope of the characteristic curve, a large thermal stress produced in this portion. However, since the nitride layer 3 exhibits a continuous change in the reduction ratio of the nitride, i.e., the slope of the characteristic curve, in the direction of depth, even such a thermal flux causes neither cracking nor peeling of the nitride layer 3.

In this case, a depth s of a portion in which the nitride content C of the nitride layer 3 becomes 50% of the nitride content of the surface of the nitride layer (to be simply referred to as a depth s hereinafter) is preferably set to be 10 nm or more, e.g., about 80 nm.

According to the nitride layer 3, the reduction ratio of the nitride is small, and the thermal stress is further reduced, thereby more reliably preventing cracking or peeling of the nitride layer. In addition, a nitride is generally higher than an oxide in thermal conductivity. Therefore, with the thick nitride layer 3 described above, the thermal conductivity of the tube wall of the envelope tube 2 in the planar direction is increased. In the discharge tube assembly 1, the temperature of the central portion of the envelope tube 2 becomes high, and the temperatures of the two end portions become low, so that thermal nonuniformity occurs in the planar direction of the tube wall of the envelope tube 2. With the above nitride layer, the thermal conductivity in the planar direction of the tube wall, e.g., between the central portion and end portions of the envelope tube 2, is increased, and the thermal nonuniformity in the planar direction of the tube wall is reduced, thereby reducing the thermal stress.

The metal halide lamp having the above arrangement is used as the light source of an illumination apparatus, as shown in, e.g., FIG. 3. Referring to FIG. 3, reference numeral 30 denotes an illumination fixture body, which has a reflecting surface 31. The illumination fixture body 30 has a housing structure with a lower surface or a side surface being open. A front surface cover 32 is mounted on the opening portion of the illumination fixture body 30. A socket 33 is mounted on a side wall of the illumination fixture body 30. The base 16 of the metal halide lamp shown in FIG. 2 is threadably engaged with the socket 33 to be mounted on the illumination fixture body 30.

The socket 33 is connected to a commercial power supply 36 via a lighting circuit 35 including a stabilizer and mounted on the illumination fixture body 30 or arranged outside the illumination fixture body 30.

In the illumination apparatus having the above arrangement, when the metal halide lamp is connected to the commercial power supply 36, the lighting circuit 35 including the stabilizer applies a starting pulse voltage between the auxiliary electrode 6 and one main electrode 5*a* which is adjacent to the auxiliary electrode 6, and between the main electrodes 5*a* and 5*b*. As a result, an auxiliary discharge starts between the auxiliary electrode 6 and one main electrode 5*a* which is adjacent thereto, leading to a main discharge between the main electrodes 5*a* and 5*b*. As a result, the discharge tube assembly 1 emits light. With this discharge, metal halides, e.g., scandium iodide $ScI_3$ and sodium iodide NaI, sealed in the discharge tube assembly 1 emit light.

The light emitted from this metal halide lamp is reflected by the reflecting surface 31 of the illumination fixture body 30 and irradiated outside via the front surface cover 32 of the opening portion.

In the metal halide lamp used as the above light source, the formation of the above nitride layer 3 on the inner surface of the envelope tube 2 of the discharge tube assembly 1 prevents contact between the quartz and discharge metals such as a metal halide sealed in the discharge tube assembly 1 and scandium Sc and sodium Na dissociated from the metal halide, and also prevents discharge metals such as metal halides or scandium Sc and sodium Na from reacting with the quartz. Therefore, the corrosion resistance of the quartz improves, and discoloration thereof is prevented. In addition, since reductions in discharge metals in the discharge tube assembly 1 are prevented, and a reduction in luminous flux is reduced, and the luminous flux maintaining rate can be increased.

Assume that scandium iodide $ScI_3$ and sodium iodide NaI are sealed, in a total amount of 10 mg at a weight ratio of 1:5, in a metal halide lamp having a discharge tube assembly inner diameter of 10.5 mm, an inter-electrode distance of 18 mm, and a rated input of 100 W. In this case, in the conventional lamp in which the nitride layer 3 is not formed on the inner surface of the discharge tube assembly 1, the luminous flux maintaining rate becomes 50% after the lamp is kept on for 6,000 hours. In contrast to this, in the lamp of the present invention, in which the nitride layer 3 whose depth s is 80 nm is formed on the inner surface of the discharge tube assembly 1, the luminous flux maintaining rate becomes 70% after the lamp is kept on for 6,000 hours. That is, the effect of the formation of the nitride layer 3 is confirmed.

As described above, since the above nitride layer 3 is a layer having a reaction structure formed by substituting oxygen $O_2$ in silicon oxide $SiO_2$ constituting the discharge tube assembly 1 with nitrogen $N_2$, there is no chance that cracking, peeling, or removal of the nitride layer 3 occurs.

If the depth s of the nitride layer 3 is 10 nm or more, the layer effectively serves to improve the corrosion resistance of quartz. If the depth s is about 80 nm, the layer exhibits a sufficient effect.

A lighting apparatus and an illumination apparatus using such metal halide lamps as light sources have high luminous flux maintaining rates.

In the metal halide lamp according to the first embodiment, scandium iodide $ScI_3$ and sodium iodide NaI are used as metal halides. However, the metal halides are not limited to these. For example, a halide of a rare metal, a halide of an alkali metal, or a halide of indium or thallium may be used.

The second embodiment of the present invention will be described next. This embodiment exemplifies a general illumination mercury lamp. The general illumination mercury lamp has substantially the same arrangement as that shown in FIGS. 1A to 3. The structure shown in FIGS. 1A to 3 is used for explaining this mercury lamp, and a description thereof will be omitted.

This mercury lamp is different from a metal halide lamp in that starting rare gases such as mercury Hg and argon Ar are sealed in a discharge tube assembly 1. In the mercury lamp, when mercury ions $Hg^+$ are injected into quartz, the discharge tube assembly 1 is blackened. More specifically, small openings are formed in the surface of quartz, and the mercury ions $Hg^+$ are attracted and injected into the small openings in the quartz surface by $OH^-$ in the glass and negative charge on the glass surface. As a result, blackening of the quartz is promoted.

In contrast to this, in this embodiment, since a nitride layer 3 similar to the one in the first embodiment shown in FIGS. 1A and 1B is formed, contact between the mercury sealed in the discharge tube assembly 1 and the quartz is prevented. This prevents mercury ions $Hg^+$ from being attracted into the small openings in the quartz surface. Therefore, blackening of the quartz is prevented.

The third embodiment of the present invention will be described next with reference to FIGS. 4 and 6. In this embodiment, the present invention is applied to a high pressure sodium lamp.

Figure 4:
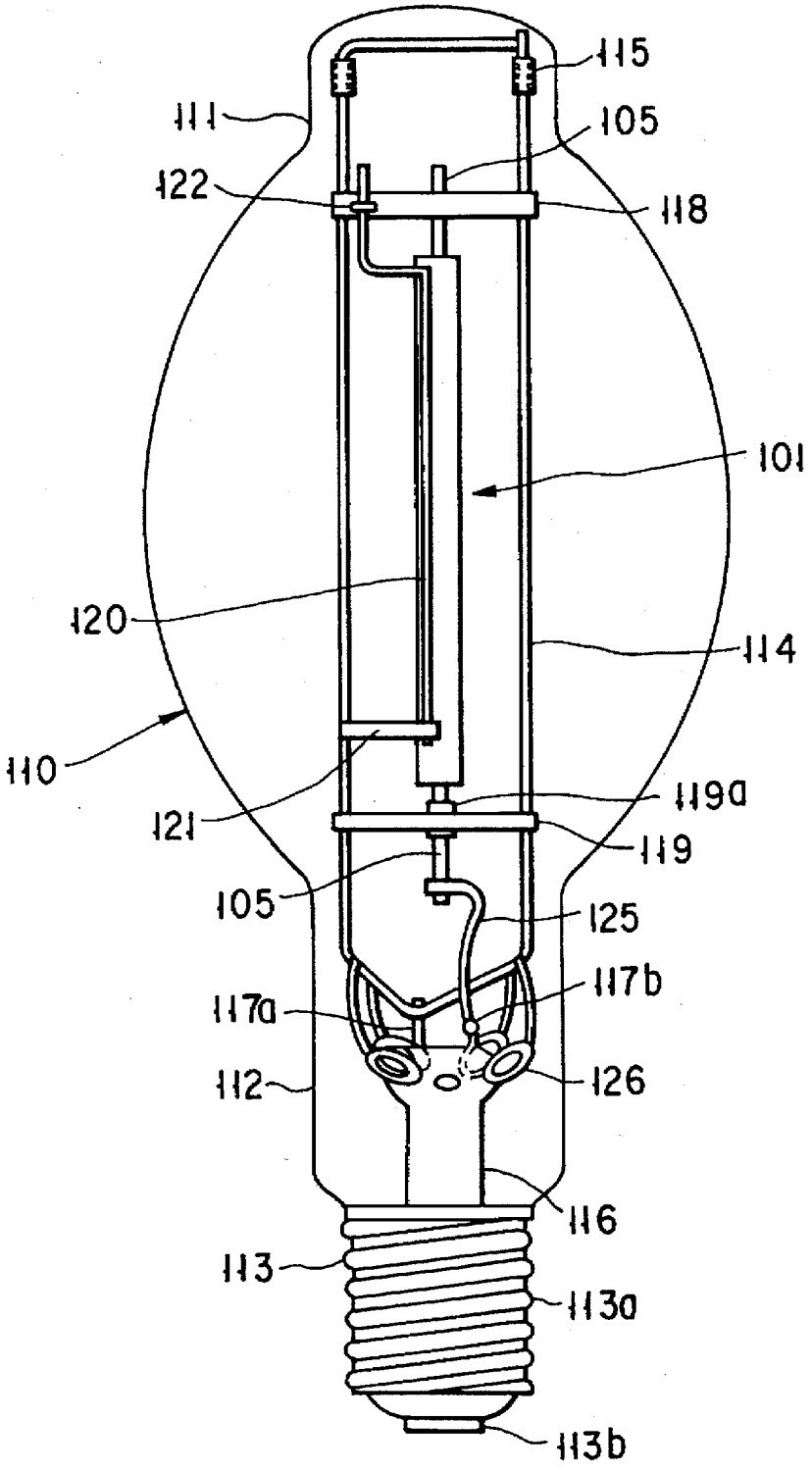
FIG. 4 is a front view showing an overall high pressure sodium lamp according to the second embodiment of the present invention.

FIG. 4 shows an overall high pressure sodium lamp. Reference numeral 110 denotes an outer tube. The outer tube 110 consists of hard glass and has a bulge at its central portion. The outer tube 110 has a small-diameter top portion 111 at an upper portion in FIG. 4 and a small-diameter neck portion 112 at a lower portion in FIG. 4, thus constituting a so-called BT form. A base 113 is mounted on the end portion of the neck portion 112. Note that a vacuum is maintained in the outer tube 110.

A discharge tube assembly 101 is housed in the outer tube 110. The structure of the discharge tube assembly 101 will be described later. In the outer tube 110, the discharge tube assembly 101 is supported by a support wire 114. The support wire 114 is a conductive wire such as a stainless wire in the form of a rectangular frame. The upper portion of the support wire 114 is locked to the top portion 111 of the outer tube 110 via elastic pieces 115, and the lower portion of the support wire 114 is welded to one seal wire 117*a* sealed in a stem 116.

One conductor 105 extending from the upper end of the discharge tube assembly 101 is electrically and mechanically connected to the support wire 114 via a conductive holder 118 serving also as a conductive wire. The other conductor 105 extending from the lower end of the discharge tube assembly 101 is mechanically supported by the other holder 119 via an insulator 119*a*. This holder 119 is mechanically mounted on the support wire 114. That is, the discharge tube assembly 101 is supported by the holders 118 and 119 at the upper and lower end portions, and is supported by the support wire 114 via the holders 118 and 119.

The conductor 105 extending from the lower end of the discharge tube assembly 101 is electrically connected, via a lead wire 125, to the other seal wire 117*b* sealed in the stem 116. The seal wires 117*a* and 117*b* are connected to a shell 113*a* and an external terminal 113*b* of the base 113.

An adjacent conductor (starter) 120 for assisting a starting operation is arranged to be adjacent to the outer surface of the discharge tube assembly 101. The adjacent conductor 120 is made of a refractory metal consisting of at least one of molybdenum, tungsten, tantalum, niobium, iron, nickel, and the like. One end of the adjacent conductor 120 is supported by a bimetallic piece 121, and the other end of the adjacent conductor 120 is pivotally supported by a lock portion 122 formed on the conductive holder 118. The proximal end of the bimetallic piece 121 is fixed to the support wire 114.

Before the lamp is started, since the temperature of the discharge tube assembly 101 and the ambient temperature are low, the adjacent conductor 120 is in contact with the outer surface of the discharge tube assembly 101 owing to the deformation of the bimetallic piece 121. When the lamp is connected to the power supply, a potential difference is made between the adjacent conductor 120 and one electrode 106 to cause a starting discharge between the adjacent conductor 120 and one electrode 106 in the discharge tube assembly 101. This starting discharge leads to a main discharge between the electrodes 106. With this operation, a starting operation is facilitated. When the lamp is turned on, the bimetallic piece 121 is subjected to thermal deformation upon reception of heat from the discharge tube assembly 101. As a result, the adjacent conductor 120 is moved away from the outer surface of the discharge tube assembly 101, thereby preventing the adjacent conductor 120 from blocking light emitted from the discharge tube assembly 101. Reference numeral 126 denotes a getter.

Figure 5:
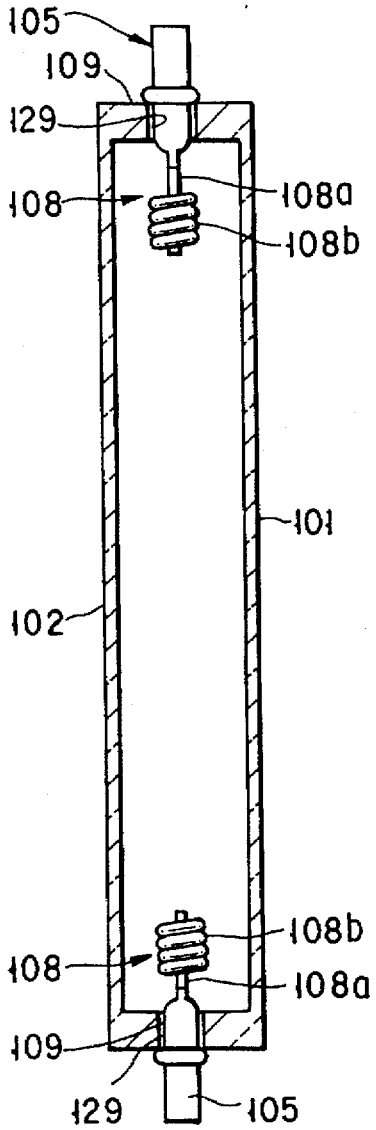
FIG. 5 is a longitudinal sectional view showing the discharge tube assembly of the lamp in FIG. 4.

The arrangement of the discharge tube assembly 101 will be described with reference to FIGS. 5 and 6. The discharge tube assembly 101 is constituted by a tube 102 consisting of a transparent ceramic material such as polycrystalline or monocrystalline alumina or sapphire (transparent alumina ($Al_2O_3$) in this embodiment). Through holes 129 are formed in the two end portions of this transparent ceramic tube 102. Conductors 105, each consisting of niobium Nb or an alloy of niobium Nb and zirconium Zn, extend through the through holes 129, respectively. The conductors 105 are hermetically joined to the two end portions of the tube 102 with a glass sealing agent 109.

Electrodes 108 are respectively welded to the conductor 105. Each electrode 108 is formed by winding an electrode coil 108*b* consisting of tungsten around the distal end portion of an electrode shaft 108*a* consisting of tungsten a plurality of number of times. An electron emissive material (emitter) such as $BaO\text{-}CaO\text{-}WO_3$ is coated on the electrode coil 108*b*.

Predetermined amounts of mercury Hg, sodium Na, and xenon Xe gas as a starting rare gas are sealed in the discharge tube assembly 101.

Figure 6:
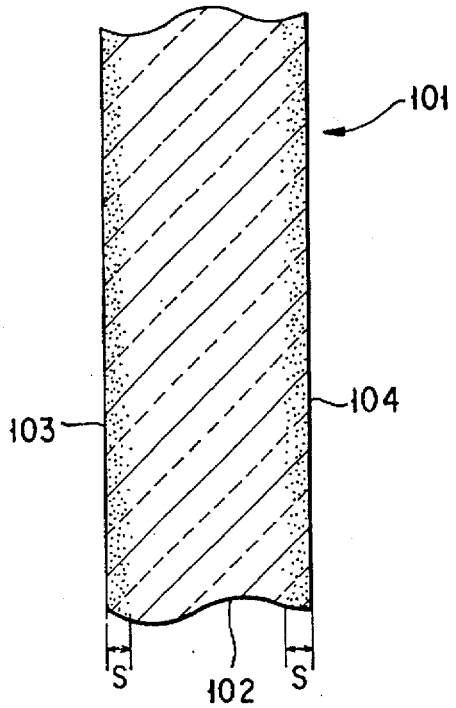
FIG. 6 is a schematic sectional view showing part of the tube wall of the discharge tube assembly in FIG. 5.

In this embodiment, nitride layers 103 and 104 like those shown in FIG. 6 are respectively formed on the inner and outer surfaces of the envelope tube, e.g., the transparent alumina ($Al_2O_3$), of the discharge tube assembly 101. Each of these nitride layers 103 and 104 is a layer having a reaction structure formed by substituting the oxygen atoms in alumina $Al_2O_3$ constituting the discharge tube assembly 1 with nitrogen atoms.

The nitride layers 103 and 104 in this embodiment are formed in the same manner as in the first embodiment, and have substantially the same arrangement as the nitride layer in the first embodiment except that aluminum nitride is used instead of silicon nitride. In addition, the characteristics representing the reduction in aluminum nitride (nitride) content in the direction of thickness/depth are substantially the same as those in the first embodiment described above. That is, the reduction characteristics in this embodiment also exhibit a continuous and smooth reduction in the direction of depth.

Furthermore, in this embodiment, the conductors 105 are sealed in the through holes 129 of the transparent ceramic tube 101 with an inorganic adhesive such as the glass sealing agent 109. If, therefore, a nitride layer is formed on the entire surface of this transparent ceramic tube 101 before sealing of the conductors 105, the sealing properties with respect to this glass adhesive may deteriorate owing to the nitride layers on the inner surfaces of the through holes 129. In such a case, a depth s of the above nitride layer is preferably set to be 100 μm or less.

In the high pressure sodium lamp having such an arrangement, the nitride layer 103 is formed on the inner surface of the discharge tube assembly 101 to prevent a reaction between sodium Na and alumina $Al_2O_3$, thereby preventing growth of crystals such as needle-like crystals and sodium loss. Therefore, a reduction in luminous flux is suppressed, and an increase in luminous flux maintaining rate can be attained.

Since the above nitride layer 103 is formed such that the nitride content continuously decreases in the direction of depth, the thermal expansion coefficient also continuously changes inward from the surface to prevent cracking, peeling, removal, and the like. In addition, the thermal conductivity increases to increase the resistance to thermal shock. Consequently, the temperature differences between the central and end portions of the discharge tube assembly 101 are reduced to improve the durability. For this reason, the thickness of the alumina tube 102 constituting the discharge tube assembly 101 may be decreased to increase the transmittance.

The high pressure sodium lamp having the above arrangement uses the adjacent conductor 120 for assisting a starting operation to facilitate a starting operation. When the lamp is started, the adjacent conductor 120 is in contact with the outer surface of the discharge tube assembly 101. The adjacent conductor 120 is kept in contact with the outer surface of the discharge tube assembly 101 until the temperature of the discharge tube assembly 101 reaches a predetermined temperature. In this state, the tube wall temperature of the discharge tube assembly 101 locally becomes high at a portion in contact with the adjacent conductor 120. For this reason, sublimation, or melting may occur, or the lamp may be turned off. In addition, a temperature difference may be caused between the portion in contact with the adjacent conductor 120 and the remaining portion to cause thermal distortion of the transparent alumina tube 102 of the discharge tube assembly 101. This may be the cause of cracks in the tube 102.

In contrast to this, in this embodiment, the nitride layer 104 is formed on the outer surface of the transparent alumina tube 102 of the discharge tube assembly 101. Since the nitride layer 104 serves to improve the thermal conductivity as described above, the heat of the portion having a high temperature can be effectively dissipated to the remaining portions having low temperatures. Therefore, sublimation or melting does not occur locally, and no thermal distortion is caused. This prevents damage to the tube. For this reason, the durability of the discharge tube assembly 101 improves.

In the above embodiment, the nitride layers 103 and 104 are respectively formed on the inner and outer surfaces of the transparent alumina tube 102 of the discharge tube assembly 101. These nitride layers 103 and 104 have different effects. Even if, therefore, the nitride layer 103 or 104 is formed on only one of the surfaces, the present invention can be practiced.

In the ceramic discharge lamp in which the discharge tube assembly 101 is constituted by the alumina tube 102, even if a metal halide is sealed as a discharge metal instead of sodium, the same effects as those described above can be obtained.

According to such a lamp, as disclosed in, e.g., Jpn. Pat. Appln. KOKAI Publication No. 5-205701, in forming a discharge tube assembly, an exhaust tube and a molybdenum Mo or tungsten W tube serving as an electrical conductor are calcined integrally with an alumina tube, i.e., undergoes so-called fritless sealing, to form a nitride layer on the inner surface of the non-exhaust discharge tube assembly member. With this process, a reaction between a sealed halide and a glass sealing agent 109 can be prevented at the same time.

The fourth embodiment of the present invention will be described next with reference to FIGS. 7 and 8. In this embodiment, the present invention is applied to an ultraviolet mercury lamp.

Figure 7:
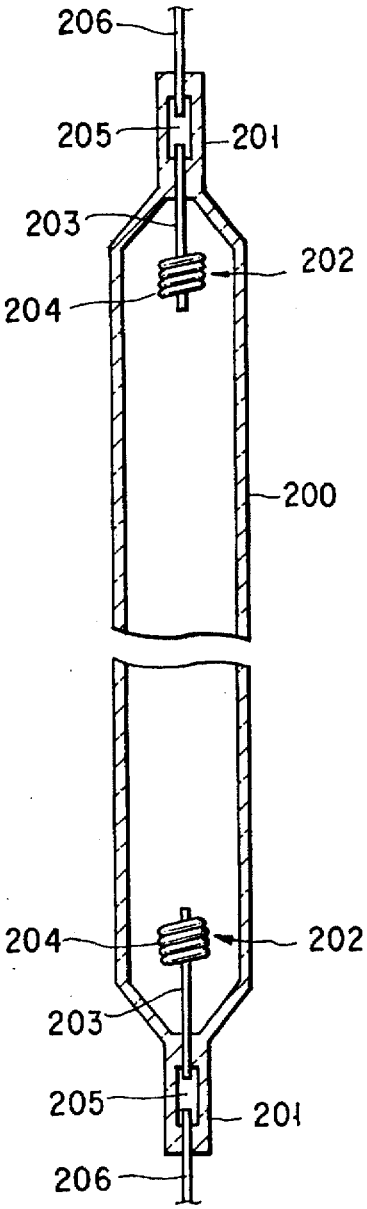
FIG. 7 is a front view showing a high pressure mercury lamp for irradiating ultraviolet rays according to the third embodiment of the present invention.
Figure 8:
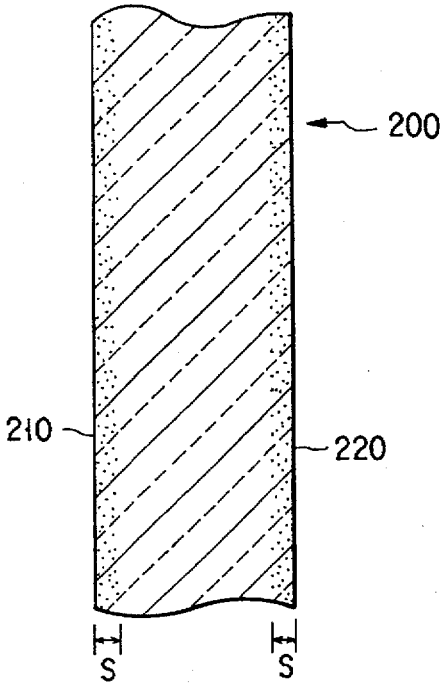
FIG. 8 is a schematic sectional view showing part of a tube wall in FIG. 7.

Referring to FIGS. 7 and 8, reference numeral 200 denotes a discharge tube assembly 200 of the ultraviolet mercury lamp. The discharge tube assembly 200 consists of quartz glass. Seal portions 201 are formed at the two end portions of the discharge tube assembly 200. Electrodes 202 are respectively sealed in the seal portions 201. Each of the electrodes 202 is formed by winding an electrode coil 204 consisting of tungsten W around an electrode shaft 203 consisting of tungsten W.

The electrode shafts 203 of the electrodes 202 are respectively connected to external lead wires 206 via metal foil conductors 205 consisting of molybdenum Mo and sealed in the seal portions 201.

In this discharge tube assembly 200, a predetermined amount of mercury Hg and argon Ar as a starting rare gas are sealed.

As shown in FIG. 8, nitride layers 210 and 220 are respectively formed on the entire inner and outer surfaces of the discharge tube assembly 200. Each of the nitride layers 210 and 220 is a surface layer formed by substituting the oxygen atoms in silica $SiO_2$ constituting quartz as a discharge tube assembly material with nitrogen atoms.

As shown in FIG. 8, in each of these nitride layers 210 and 220 as well, the nitride content continuously decreases from the surface of the discharge tube assembly 200 in the direction of depth of the bulb wall, and a depth s is set to be 10 nm or more, e.g., about 80 nm, although there is no clear boundary.

For example, such an ultraviolet mercury lamp is used as a lamp for sterilizing coliform bacilli in a water treatment. In a lamp having a discharge tube assembly inner diameter of 20 mm, and an effective emission length of 350 mm, and a rated input of 1,600 W, the lamp voltage is set to be 410 V; the lamp current, 4.4 A; and the estimated mercury vapor pressure during a lamp-on operation, 66.6 KPa.

When this ultraviolet mercury lamp is turned on, mercury ions $Hg^+$ are injected into quartz to blacken the discharge tube assembly, as in the case of the general illumination mercury lamp described in the second embodiment. That is, small openings are formed in the surface of the quartz, and the above mercury ions $Hg^+$ are attracted and injected into the small openings in the quartz surface by $OH^-$ in the glass and negative charge on the glass surface. As a result, blackening of the quartz is promoted.

In contrast to this, in this embodiment, as shown in FIG. 8, since the nitride layer 210 is formed on the inner surface of the quartz, contact between the quartz and the mercury sealed in the discharge tube assembly 200 of the nitride layer 210 is prevented, and the mercury ions $Hg^+$ are prevented from being attracted into the small openings in the quartz surface. This prevents blackening of the quartz and increases the luminous flux maintaining rate.

It was confirmed that the ultraviolet mercury lamp with the nitride layer 210 in this embodiment was 1.2 times higher in the output of 254-nm ultraviolet radiation than a conventional ultraviolet mercury lamp without the nitride layer 210. It was also confirmed that a luminous flux maintaining rate of 75% or more, which was higher than that of the conventional ultraviolet mercury lamp by 5% or more, was kept after the lamp was kept on for 10,000 hours.

The above ultraviolet mercury lamp may be used as a light source for drying an ultraviolet-curing ink. More specifically, in a printing apparatus using an ultraviolet-curing ink, an ink can be dried immediately after a printing operation by irradiating ultraviolet rays from the ultraviolet mercury lamp. In comparison with a printing machine of a natural drying scheme, such a printing apparatus can save a space for a standby operation during a drying time, and the drying speed is high. Of the existing inks, however, some color ink is not sufficiently dried by only ultraviolet rays from the mercury lamp. If, therefore, print sheets are stacked on each other immediately after irradiation of ultraviolet rays, a print corresponding to an ink portion which is not dried is soiled. In order to solve this problem, a thin film of a starch powder (carbohydrate) is coated on a printed surface to prevent the soil of a print.

Such a carbohydrate powder is floating in the atmosphere irradiated by the ultraviolet mercury lamp, and hence may adhere to the surface of the ultraviolet mercury lamp. The discharge tube assembly of the ultraviolet mercury lamp consists of quartz, and the temperature of the discharge tube assembly reaches 700° to 800° C. during a lamp-on operation. For this reason, the carbohydrate powder (starch powder) adhering to the surface of the quartz may impair the transparency of the quartz and make the quartz nebulous.

In this embodiment, as shown in FIG. 8, the nitride layer 220 is formed on the discharge tube assembly 200 consisting of quartz. This nitride layer 220 prevents a carbohydrate powder (starch powder) from coming into contact with the quartz as the discharge tube assembly material. This prevents the transparency of the quartz from being impaired, and increases the luminous flux maintaining rate.

In an ultraviolet mercury lamp having a tube outer diameter of 27 mm, an effective emission length of 1,000 mm, and a rated input of 8,000 W, the formation of the nitride layer 220 on the outer surface of the discharge tube assembly 200 prevented the quartz from becoming nebulous after the lamp was kept on for 1,000 hours. In contrast to this, in some conventional ultraviolet mercury lamp in which the nitride layer 220 was not formed on the outer surface of the discharge tube assembly 200, the quartz became nebulous even after the lamp was kept on for 500 hours.

The ultraviolet lamp shown in FIGS. 7 and 8 is not limited to the mercury lamp. For example, a metal halide lamp having mercury and a metal halide sealed in a discharge tube assembly may be used as an ultraviolet light source.

In the above embodiment as well, the nitride layers 210 and 220 are respectively formed on the outer and inner surfaces of the discharge tube assembly 200. These nitride layers 210 and 220 have different effects. Even if, therefore, the nitride layer 210 or 220 is formed on only one of the surfaces, the present invention can be practiced. The case wherein the nitride layer 210 is formed on the inner surface of the discharge tube assembly 200 corresponds to claim 3 of the present invention. The case wherein the nitride layer 220 is formed on the outer surface of the discharge tube assembly 200 corresponds to claim 5 of the present invention.

The fifth embodiment of the present invention will be described next with reference to FIG. 9. In this embodiment, the present invention is applied to a lamp called a non-electrode discharge lamp.

Figure 9:
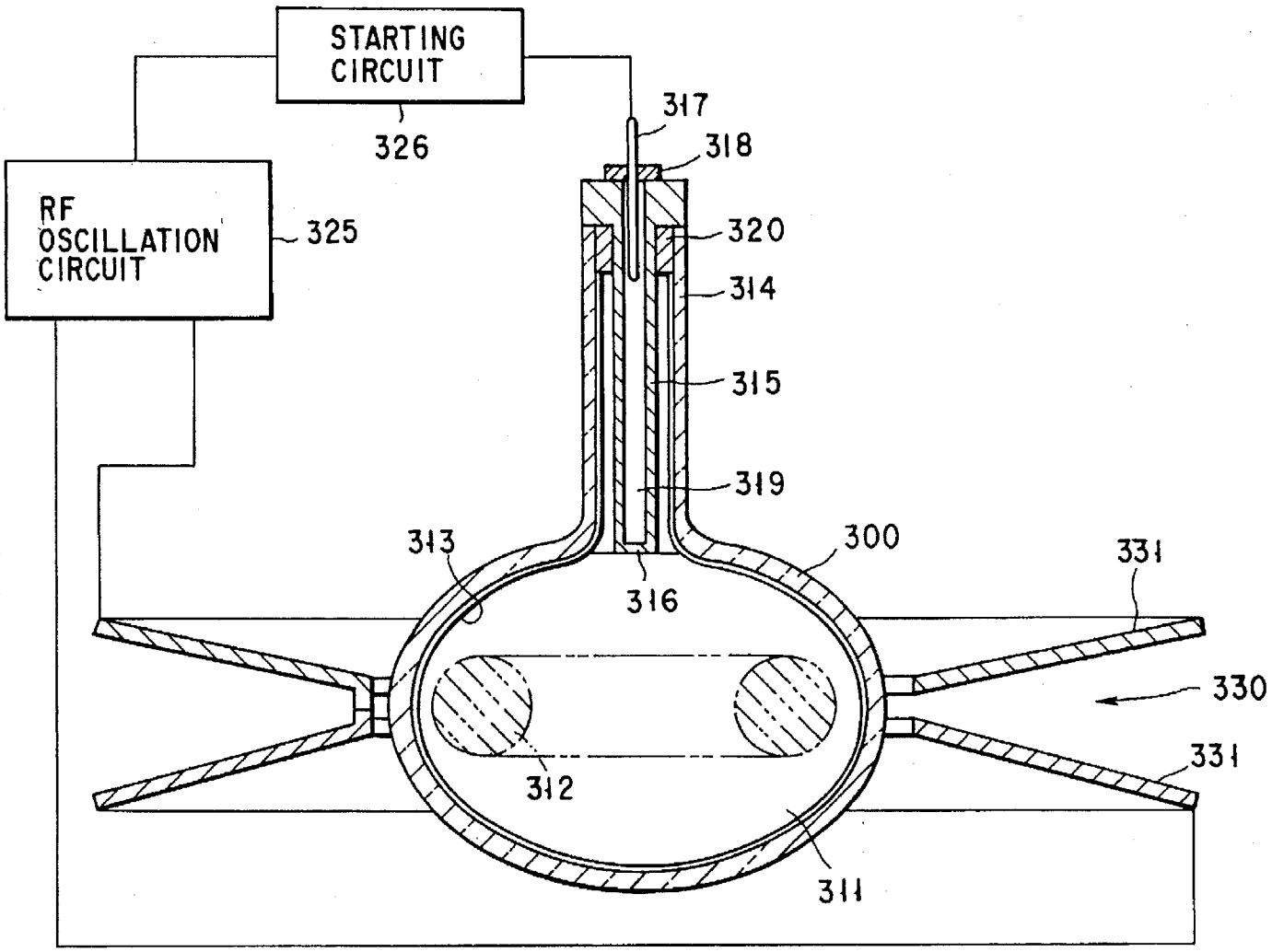
FIG. 9 is a longitudinal sectional view showing a magnetic induction type non-electrode discharge lamp according to the fourth embodiment of the present invention.

Referring to FIG. 9, reference numeral 300 denotes a discharge tube assembly of a magnetic induction coupling type non-electrode discharge lamp. The discharge tube assembly 300 consists of a monocrystalline or polycrystalline transparent ceramic material such as transparent alumina, sapphire, or garnet, or quartz, and has an almost flat spherical outer shape. In a discharge space 311 formed in the discharge tube assembly 300, emissive materials such as metal halides, e.g., scandium iodide $ScI_3$ and sodium iodide NaI, which emit light upon a plasma discharge 312 produced in the form of a doughnut, and a starting rare gas consisting of at least one of argon, xenon, krypton, and neon are sealed.

A cylindrical protruding portion 314 is integrally formed on one end of the discharge tube assembly 300. One end of the cylindrical protruding portion 314 communicates with the discharge space 311, and the other end of the portion 314 is sealed by a starting probe 315 (to be described later).

A nitride layer 313 is formed on the inner surface of the discharge tube assembly 300. The nitride layer 313 is a surface layer formed by substituting the oxygen atoms in a transparent ceramic material as a discharge tube assembly material, e.g., alumina $Al_2O_3$, with nitrogen atoms. In this nitride layer 313 as well, the nitride content continuously reduces in the direction of depth of the bulb wall. A depth s of the nitride layer 313 is set to be 10 nm or more, e.g., about 80 nm.

The starting probe 315 is inserted into the cylindrical protruding portion 314. The starting probe 315 is made of a small-diameter ceramic tube. The inner end portion of the cylindrical protruding portion 314 which is inserted into the cylindrical protruding portion 314 is sealed by a seal wall 316, and the seal wall 316 faces the discharge space 311.

The other end of the starting probe 315 is hermetically sealed by a starting electrode 317. The starting electrode 317 consists of a conductive metal such as niobium, stainless steel, or copper Cu. The starting electrode 317 is hermetically joined to the other end of the starting probe 315 via a glass adhesive 318.

The starting electrode 317 is connected to an RF oscillation circuit 325 via a starting circuit 326.

A starting discharge space 319 is formed in the starting probe 315. At least one of rare gases such as argon, xenon, krypton, neon, and the like, which produces a discharge upon electric field coupling is sealed in the starting discharge space 319.

The starting probe 315 having the above arrangement is inserted into the cylindrical protruding portion 314 extending from the discharge tube assembly 300. The outer end portion of the cylindrical protruding portion 314 is hermetically joined to the outer end portion of the starting probe 315 with another glass adhesive 320.

A high-frequency excitation coil 330 is wound around the discharge tube assembly 300. The high-frequency excitation coil 330 has conductors corresponding to coil strands. These conductors are constituted by a pair of annular metal disks 331, each consisting of a metal having a high conductivity, e.g., high-purity aluminum, copper, or silver. The pair of annular metal disks 331 are arranged along the coil axis to oppose each other. Portions of the inner circumferential portions of the nitride layer 313 are welded and connected to each other to form a helical energization path as a whole. That is, each of the annular metal disks 331 is not continuous in the circumferential direction but is separated at a portion in the circumferential direction. The inner circumferential portion of one annular metal disk 331 is partly connected to that of the other annular metal disk 331 to form a helical energization path as a whole.

The high-frequency excitation coil 330 constituted by this pair of annular metal disks 331 is connected to the RF oscillation circuit 325, and a high-frequency current having, e.g., a frequency of about 13.56 MHz flows from the RF oscillation circuit 325 to the high-frequency excitation coil 330. With this high-frequency current, a magnetic field is produced in the high-frequency excitation coil 330 along the coil axis, and a doughnut-like plasma is produced, by this magnetic field, around the coil axis in the discharge tube assembly 300 housed in the central space in the high-frequency excitation coil 330. As a result, the plasma discharge 312 is generated by magnetic field coupling. The discharge medium is ionized and excited by the plasma discharge 312 to emit light. This light is transmitted through the tube wall of the discharge tube assembly 300 to be irradiated outside.

When the induction coupling type non-electrode discharge lamp having the above arrangement is to be started, a starting voltage is applied from the RF oscillation circuit 325 to the starting electrode 317 via the starting circuit 326, and at the same time, a high-frequency current is supplied to the high-frequency excitation coil 330, thereby producing an electric field based on a high-frequency magnetic field in the discharge space 311 in the discharge tube assembly 300. A potential difference is then made between the starting electrode 317 and the electric field in the discharge tube assembly 300. As a result, the rare gas sealed in the starting discharge space 319 produces a glow discharge.

Since this glow discharge produces an electric field gradient with respect to the electric field in the discharge tube assembly 300, a plasma discharge is induced in the discharge space 311 by this starting discharge. As a result, the doughnut-like plasma discharge 312 is produced.

When the doughnut-like plasma discharge 312 is produced in the discharge space 311 in this manner, the discharge material in the discharge space 311 is ionized and excited. The resultant light is irradiated outside through the tube wall of the discharge tube assembly 300.

In the induction coupling type non-electrode discharge lamp, which operates in the above manner, since the nitride layer 313 is formed on the inner surface of the discharge tube assembly 300, a reaction between the discharge metal and the transparent ceramic material and injection of discharge metal ions into the transparent ceramic material are prevented. This prevents impairing of the transparency of the discharge tube assembly 300 and blackening thereof. As a result, the luminous flux maintaining rate is increased.

The method of forming a nitride layer on a surface of the envelope tube in the present invention is not limited to the method of heating the envelope tube in an ammonia gas atmosphere as in the case described above. For example, a method of injecting nitrogen ions into a surface of the tube wall of the envelope tube may be employed.

Figure 11:
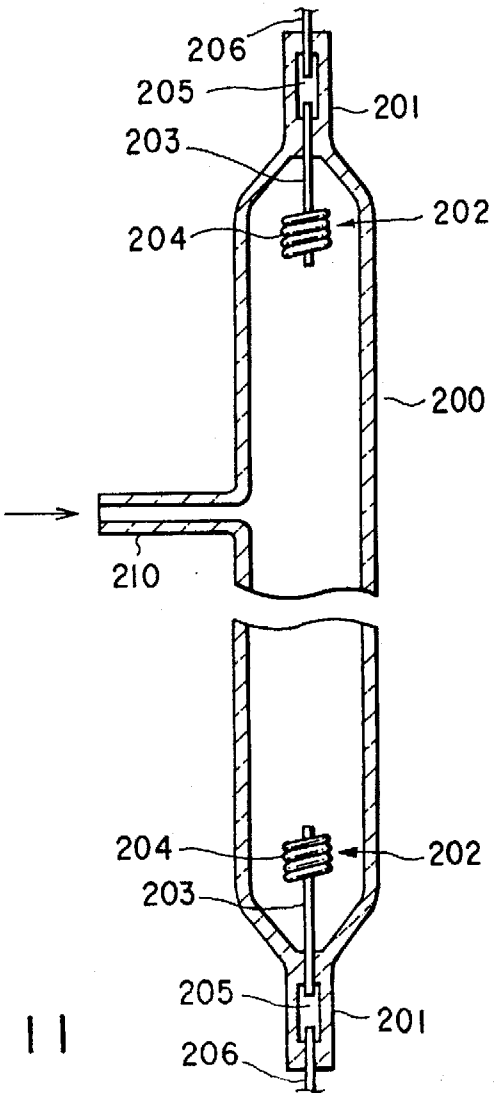
FIG. 11 is a sectional view for explaining a method of forming a nitride layer.

As shown in FIG. 11, ammonia gas and other gases may be sealed in a complete discharge tube assembly 200 via an exhaust tube 210 before discharge media such as a discharge metal and a starting gas are sealed in the discharge tube assembly 200, and a nitride layer may be formed on the inner surface of the tube wall of the envelope tube of the discharge tube assembly 200 by heating the discharge tube assembly 200 or producing a discharge therein. This process can prevent a deterioration in the affinity of each metal foil conductor 205 in a seal portion 201 due to this nitride layer.

In addition, a thin nitride film may be formed first on the surface of the tube wall of an envelope tube, and nitrogen atoms in the nitride film and oxygen atoms in the oxide material of the tube wall of the envelope tube may be diffused and substituted with each other afterward by means of, e.g., heating the envelope tube for a predetermined period of time, thereby forming a nitride layer. In this method as well, since these nitrogen and oxygen atoms are diffused in the materials with a behavior at the atomic level, this nitride layer exhibits a continuous and smooth reduction in nitride content in the direction of depth.

The present invention is not limited to the arrangement of each embodiment described above. Various changes and modifications can be made within the spirit and scope defined in the appended claims.

Additional advantages and modifications will readily occur to those skilled in the art. Therefore, the invention in its broader aspects is not limited to the specific details, and representative devices shown and described herein. Accordingly, various modifications may be made without departing from the spirit or scope of the general inventive concept as defined by the appended claims and their equivalents.

What is claimed is:

1. A discharge lamp including a discharge tube assembly constituted by an envelope tube having a tube wall mainly comprising an oxide material, and a discharge medium sealed in said envelope tube, and means for producing a discharge in said discharge tube assembly, comprising:

a nitride layer containing a nitride and partly formed near at least an inner surface of said envelope tube, wherein said nitride layer exhibits a continuous and smooth reduction in nitride content in a direction of depth of the tube wall, wherein said nitride layer is formed by substituting oxygen atoms in the oxide material constituting the tube wall of said envelope tube with nitrogen atoms, and said nitride layer having a portion in which a nitride content is 50% of that of a surface of said nitride layer is located at a depth that is not less than 10 nm from the surface.

2. A lamp according to claim 1, wherein said nitride layer is formed by coating a film containing a nitrogen on a surface of the tube wall of said envelope tube and diffusing and substituting nitrogen atoms in the film for oxygen atoms in the oxide material of the tube wall.

3. A lamp according to claim 1, wherein said discharge lamp is a metal halide lamp having a metal halide as a discharge medium sealed in an envelope tube mainly comprising a quartz material, and a nitride layer containing silicon nitride is formed near the inner surface of said envelope tube.

4. A lamp according to claim 1, wherein said discharge lamp is a mercury lamp having mercury as a discharge medium sealed in an envelope tube mainly comprising a quartz material, and a nitride layer containing silicon nitride is formed near the inner surface of said envelope tube.

5. A lamp according to claim 1, wherein said discharge lamp is a ceramic discharge lamp having sodium or a metal halide as a discharge medium sealed in an envelope tube mainly consisting of a transparent ceramic material, and a nitride layer containing a nitride is formed near the inner surface of said envelope tube.

6. A lamp according to claim 5, further comprising a discharge tube assembly having sodium or a metal halide as a discharge medium sealed in an tube mainly comprising a transparent ceramic material, and wherein a nitride layer containing a nitride is formed near an outer surface of said envelope tube in said ceramic discharge lamp in which an adjacent conductor for assisting a starting operation is mounted outside said discharge tube assembly.

7. A lamp according to claim 5, wherein in a discharge tube assembly in which a through hole is formed in said tube, and a conductor of said discharge means is inserted and sealed in the through hole with an inorganic adhesive, said nitride layer on at least an inner surface of the through hole is formed such that a depth of a portion in which a nitride content decreases to 50% of a nitride content of a surface of said nitride layer is not more than 100 μm from the surface.

8. A lamp according to claim 1, wherein said discharge tube assembly has said nitride layer formed on a surface of said envelope tube after an electrode is sealed in said envelope tube.

9. An illumination apparatus comprising:

a discharge lamp, said discharge lamp including a discharge tube assembly constituted by an envelope tube having a tube wall mainly consisting of an oxide material, and a discharge medium sealed in said envelope tube, and means for producing a discharge in said discharge tube assembly, comprising a nitride layer containing a nitride and partly formed near at least an inner surface of said envelope tube, wherein said nitride layer exhibits a continuous and smooth reduction in nitride content in a direction of depth of the tube wall.

10. An illumination apparatus as claimed in claim 9, further comprising:

a lighting circuit, for causing said discharge lamp to emit light and for maintaining a lamp-on state.

11. An illumination apparatus as claimed in claim 9, further comprising:

a fixture body in which said discharge lamp is housed.

* * * * *